US009852671B2

(12) United States Patent
Wang

(10) Patent No.: US 9,852,671 B2
(45) Date of Patent: Dec. 26, 2017

(54) GRAY LEVEL CONTROL METHOD AND OPTICAL PROJECTION SYSTEM

(71) Applicant: DELTA ELECTRONICS, INC., Taoyuan Hsien (TW)

(72) Inventor: Yu-Chang Wang, Taoyuan Hsien (TW)

(73) Assignee: Delta Electronics, Inc., Taoyuan (TW)

( * ) Notice: Subject to any disclaimer, the term of this patent is extended or adjusted under 35 U.S.C. 154(b) by 157 days.

(21) Appl. No.: 14/278,734

(22) Filed: May 15, 2014

(65) Prior Publication Data

US 2015/0062205 A1 Mar. 5, 2015

(30) Foreign Application Priority Data

Aug. 29, 2013 (TW) ..... 102130974 A

(51) Int. Cl.
*G09G 5/10* (2006.01)
*G09G 3/00* (2006.01)
*G09G 3/20* (2006.01)

(52) U.S. Cl.
CPC ..... *G09G 3/001* (2013.01); *G09G 3/003* (2013.01); *G09G 3/2018* (2013.01); *G09G 3/2022* (2013.01)

(58) Field of Classification Search
CPC ..... G09G 3/3413; G09G 3/001; G09G 5/10; G09G 5/02; G09G 5/00; G06K 9/00; G06F 3/038
USPC ..... 345/697
See application file for complete search history.

(56) References Cited

U.S. PATENT DOCUMENTS

2003/0021002 A1* 1/2003 Kruschwitz ..... H04N 9/3132 359/264
2005/0179706 A1 8/2005 Childers
2010/0073405 A1* 3/2010 Campbell ..... G09G 3/3629 345/690
2010/0128225 A1* 5/2010 Nishino ..... G02B 26/0841 353/31

FOREIGN PATENT DOCUMENTS

WO WO 2009/032342 3/2009

* cited by examiner

*Primary Examiner* — Pegeman Karimi
(74) *Attorney, Agent, or Firm* — Muncy, Geissler, Olds & Lowe, P.C.

(57) ABSTRACT

The invention provides a gray level control method for outputting a total gray level during a total period, including: dividing the total period into M unit periods; alternatively outputting a gray level "0" or a selected gray level during each unit period; and integrating the gray levels output during the M unit periods to obtain the total gray level, wherein during each of N successive unit periods of the M unit periods the selected gray level is a first gray level, and during each of the remaining (M−N) unit periods the selected gray level is lower than the first gray level.

19 Claims, 5 Drawing Sheets

GRAY LEVEL CONTROL METHOD AND OPTICAL PROJECTION SYSTEM

CROSS REFERENCE TO RELATED APPLICATIONS

This Application claims priority of Taiwan Patent Application No. 102130974, filed on Aug. 29, 2013, the entirety of which is incorporated by reference herein.

BACKGROUND OF THE INVENTION

Field of the Invention

The present invention relates to a gray level control method and an optical projection system, and in particular to a gray level control method and an optical projection system capable of utilizing the bandwidth of a light modulator effectively, improving the overall brightness, and lowering the switching frequency of a light source.

Description of the Related Art

A projector technique is using pulse width modulation (PWM) to control the number of times that a light modulator (for example, a digital micro-mirror device) is switched to form a gray level of a projection image. A naked-eye 3D projector is an important development direction of the present projector. When the naked-eye 3D projector uses multiple light sources and a time-division multiplexing method to output multi-view images, the number of images displayed within in a display period is proportional to the switching frequency of the light modulator. However, the switching frequency of the light modulator, for example, a digital micro-mirror device, has physical limitations which limit the number of images.

In order to utilize the limited bandwidth of a light modulator, pulse width modulation or pulse amplitude modulation (PAM) can be further applied to modulate the brightness of the light source to lower the switching number the light modulator needs for outputting a gray level. However, this method makes the light source change its brightness in accordance with switching time of the light modulator, so the overall light is lowered. In addition, rapidly switching a light source also has physical limitations.

In view of this, the invention provides a gray level control method and an optical projection system capable of utilizing the bandwidth of a light modulator effectively, improving the overall brightness, and lowering the switching frequency of a light source.

BRIEF SUMMARY OF THE INVENTION

A detailed description is given in the following embodiments with reference to the accompanying drawings.

The invention provides a gray level control method for outputting a total gray level during a total period, including: dividing the total period into M unit periods; alternatively outputting a gray level "0" or a selected gray level during each unit period; and integrating the gray levels output during the M unit periods to obtain the total gray level, wherein during each of N successive unit periods of the M unit periods the selected gray level is a first gray level, and during each of the remaining (M−N) unit periods the selected gray level is lower than the first gray level.

In the gray level control method, the gray levels output during the remaining (M−N) unit periods can be integrated to be any gray level lower than the first gray level.

In the gray level control method, the ratio of N to M is at least 60%. For example, M is 19, N is 15, the first gray level is a gray level "16", and the selected gray levels lower than the first gray level comprises: a gray level "8", a gray level "4", a gray level "2", and a gray level "1".

In the gray level control method, the gray level "0" and the selected gray level correspond to the brightness provided by a light source, wherein the gray level "0" corresponds to full darkness, and the first gray level corresponds to the maximum brightness of the light source.

In the gray level control method, the light source is a pulse width modulation light source, and the gray level output during a unit period corresponds to the number of times that the pulse width modulation light source is switched on during that unit period. Otherwise, the light source is a pulse width modulation light source or a pulse amplitude modulation light source, and the total period is in synchronization with the period of a brightness waveform generated from the light source driven by a pulse.

In the gray level control method, the N successive unit periods are equal to a period in which the brightness is maintained at the maximum brightness in the brightness waveform, and the remaining (M−N) unit periods are distributed into a period in which the brightness increases gradually in the brightness waveform and a period in which the brightness decreases gradually in the brightness waveform.

The gray level control method further includes: adjusting the length of the total period or the arrangement of the M unit periods according to the brightness waveform, or adjusting the brightness waveform according to the arrangement of the M unit periods.

The invention also provides an optical projection system, including: a light source; a light source driver driving the light source to change the brightness of the light source; a light modulator selectively switching whether or not to output the light from the light source; and a controller controlling the light modulator and the light source driver, wherein the controller controls the light modulator to divide a total period into M switching periods, and controls the light source driver to drive the light source to output a selected brightness during each switching period. During each of N successive unit periods of the M unit periods the brightness of the light source is equal to a first brightness, and during each of the remaining (M−N) unit periods the brightness of the light source is lower than the first brightness. The overall brightness output from the light modulator during the M unit periods corresponds to a total gray level.

In the optical projection system, the overall brightness output from the light modulator during the remaining (M−N) unit periods can correspond to any gray level which is lower than the gray level represented by the first brightness.

In the optical projection system, the ratio of N to M is at least 60%. For example, M is 19, N is 15, the first brightness corresponds to a gray level "16", and any gray level which is lower than the gray level of the first brightness comprises: a gray level "8", a gray level "4", a gray level "2", and a gray level "1".

In the optical projection system, the light source is a pulse width modulation light source, and the brightness output from the light source during a unit period corresponds to the number of times that the pulse width modulation light source is switched on during that unit period. Otherwise, the light source is a pulse width modulation light source or a pulse amplitude modulation light source, and the controller controls the light modulator and the light source driver to make the total period be in synchronization with the period of a brightness waveform generated from the light source driven by a pulse.

In the optical projection system, the N successive unit periods are equal to a period in which the brightness is maintained at the maximum brightness in the brightness waveform, and the remaining (M−N) unit periods are distributed into a period in which the brightness increases gradually in the brightness waveform and a period in which the brightness decreases gradually in the brightness waveform.

The optical projection system further includes: a sensor sensing the brightness waveform of light from the light source through the light modulator. The controller can control the light modulator to adjust the length of the total period or the arrangement of the M switching periods according to the brightness waveform sensed by the sensor. Otherwise, the controller can control the light source driver to adjust the brightness waveform of the light source according to the arrangement of the M switching periods.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
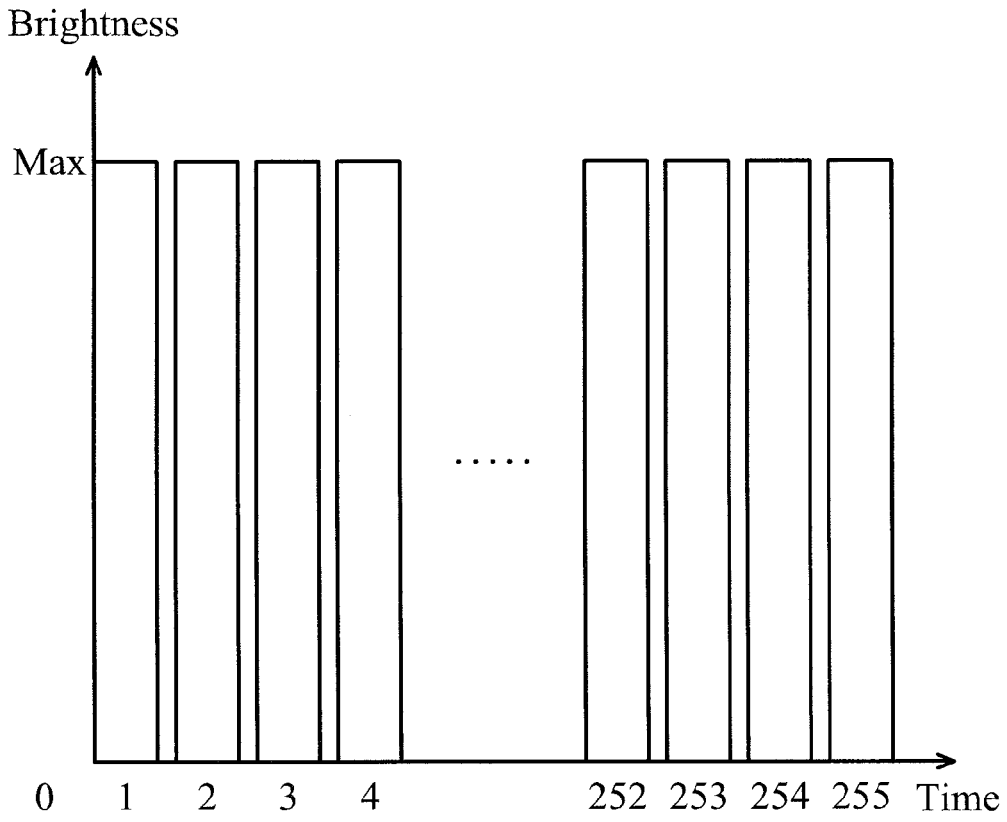
FIG. 1 ( PRIOR ART )
FIG. 1 is a diagram showing a gray level formed by modulating a light modulator.

FIG. 1 is a diagram showing a gray level formed by modulating a light modulator. In cases where pulse width modulation is used to control the switching of a light modulator to produce a gray level, the conventional method is shown in FIG. 1. The horizontal axis represents time wherein the number means time sequence in which the light modulator is switched, and the vertical axis represents brightness. In FIG. 1 the brightness during any unit period (the unit period is a period in which the light modulator performs a switching, so it is also called a switching period) is fixed to the maximum value in an exemplary manner, but the light modulator can selectively decide whether or not to output light of the light source by switching on or off the light modulator. Therefore, a gray level "0" or a gray level "1" can be output during each unit period.

In FIG. 1, an 8-bit gray level signal is input to the light modulator. The light modulator has to produce any one gray level of 256 ($=2^8$) gray levels during a predetermined display period. A gray level is produced from a combination of the number of times that the light modulator is switched on and the number of times that the light modulator is switched off. A gray level "1" and a gray level "0" is output by switching the light modulator on and off once respectively, so any one of gray levels 0~255 can be output after 255 times that the light modulator is switched on or off. For example, the light modulator is switched on 255 times successively to output a gray level "255" and the light modulator is switched off 255 times successively to output a gray level "0". Namely, to display a gray level "N" the light modulator should be switched on N times.

In this gray level forming method, the maximum number of gray levels is equal to the number of times the light modulator is switched. Therefore, if the projector desires a larger maximum of the number of gray levels (for example, 1024 gray levels) or the projector desires more images (for example, more than 2 images), the light modulator has to bear the more number of times to switch within a limited period. However, the switching frequency of the light modulator has physical limitations.

Figure 2:
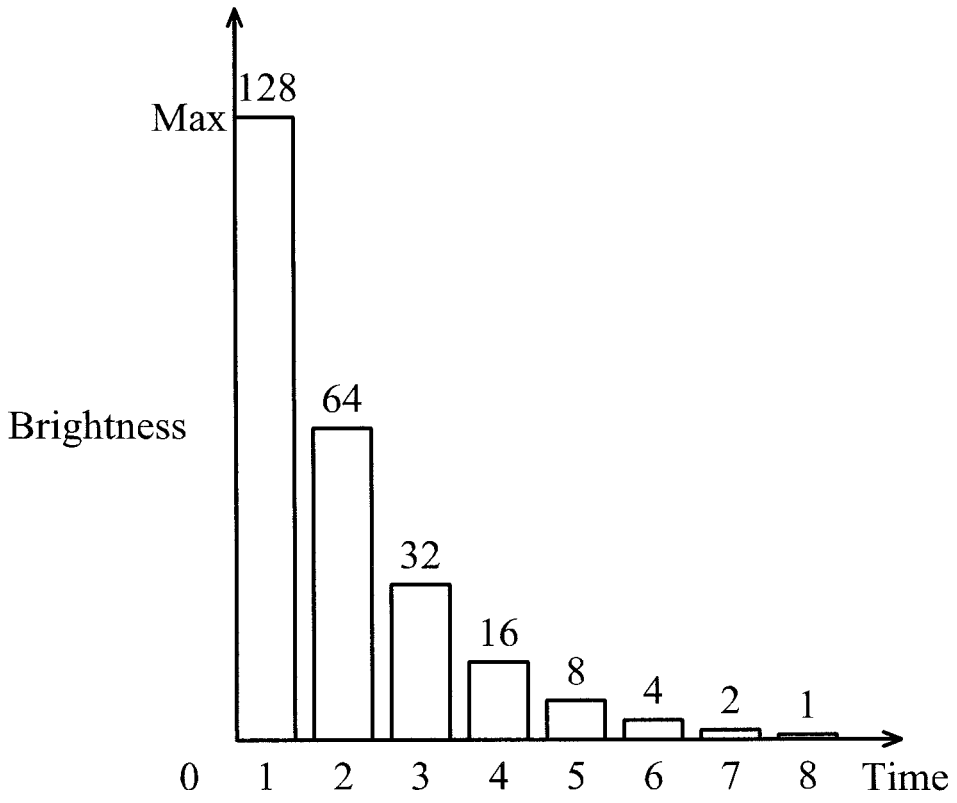
FIG. 2 ( PRIOR ART )
FIG. 2 is a diagram showing a gray level formed by modulating a light modulator as well as a light source.

FIG. 2 is a diagram showing a gray level formed by modulating a light modulator as well as a light source. In cases where light modulator modulation and light source brightness modulation are both used to produce a gray level, the conventional method is shown in FIG. 2. The horizontal axis represents time wherein the numerals mean a time sequence in which the light modulator is switched, and the vertical axis represents brightness, wherein the light source brightness varies in accordance with the time sequence in which the light modulator is switched. Here, in response to 8 times that the light modulator is switched, the light source outputs 8 brightness with a ratio of 128:64:32:16:8:4:2:1 during the 8 unit periods, respectively. According to the switching of the light modulator, the light modulator decides whether or not to output light from the light source. Therefore, a gray level "0" or a gray level "128" can be output during the first unit period, a gray level "0" or a gray level "64" can be output during the second unit period, and so on. In FIG. 2, the number labeled above the rectangle during a unit period means a gray level value except a gray level "0" which can be output during that unit period.

In FIG. 2, any gray level in 256 gray levels can still be displayed by light modulator modulation and light source brightness modulation. For example, a gray level "137" is output by switching on the light modulator during the $1^{st}$, $5^{th}$, and $8^{th}$ unit periods and switching off the light modulator during the $2^{nd}$, $3^{rd}$, $4^{th}$, $6^{th}$ and $7^{th}$ unit periods. Therefore, a gray level "128", a gray level "8", and a gray level "1" are output and added up to a total gray level "137".

In comparison with the gray level forming method shown in FIG. 1, the method shown in FIG. 2 only need 8 times that the light modulator is switched to output the same number of gray levels. Therefore, the data amount for the light modulator outputting a gray level is reduced to 1/32 (=8/256) of that by using the method shown in FIG. 1. The limited bandwidth of the light modulator is utilized effectively. However, in terms of a light source, it only outputs the maximum brightness during the $1^{st}$ unit period and decreases its output brightness gradually during the following unit periods. Thus, the overall brightness of the maximum gray level is reduced to about 25% (=(128+64+32+16+8+4+2+1)/128*8) of the maximum of the overall brightness the light source can output. A substantial decrease of brightness is a main shortcoming while adopting this gray level forming method. Moreover, the light source brightness modulation can be achieved by pulse width modulation (PWM) or pulse amplitude modulation (PAM). If the light source is also a PWM light source, it has to be switched on or off at least 128 times during a unit period to generate light of which the ratio of the maximum brightness and the minimum brightness is 128:1. Namely, the switching frequency of the light source must be at least 128 times the switching frequency of the light modulator. However, a rapid-switching light source has physical limitations, which makes it difficult to implement.

Figure 3:
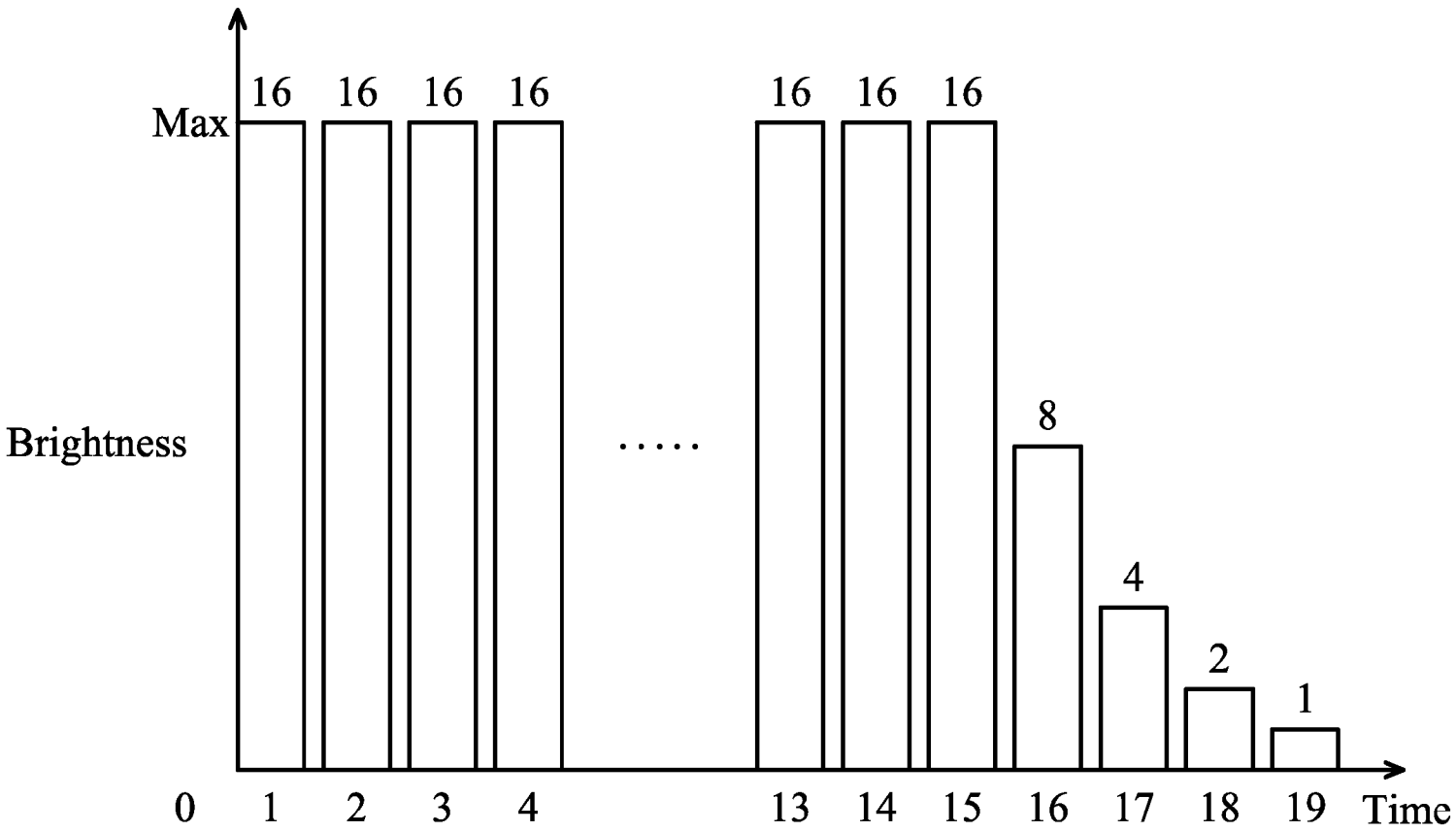
FIG. 3 is a diagram showing a gray level is formed by modulating a light modulator as well as a light source in accordance with Embodiment 1 of the present invention.

FIG. 3 is a diagram showing a gray level is formed by modulating a light modulator as well as a light source in accordance with Embodiment 1 of the present invention. In this embodiment, the brightness of the light source is also varied in accordance with the time sequence in which the light modulator is switched. Here, in response to 19 times that the light modulator is switched, the light source outputs 19 brightness with a ratio of 16:16:16:16: . . . :16:16:16:8:4:2:1 during the 19 unit periods, respectively. Namely, the gray level which can be output during a unit period is shown as the number labeled above the rectangle during that unit period. During each of the $1^{st}$ to $15^{th}$ unit periods, a gray level "0" or a gray level "16" can be output. During the $16^{th}$ unit period, a gray level "0" or a gray level "8" can be output. During the $17^{th}$ unit period, a gray level "0" or a gray level "4" can be output. During the $18^{th}$ unit period, a gray level "0" or a gray level "2" can be output. During the $19^{th}$ unit period, a gray level "0" or a gray level "1" can be output.

In FIG. 3, any gray level in 256 gray levels can still be displayed by light modulator modulation and light source brightness modulation. For example, a gray level "137" is output by switching on the light modulator during any 8 unit periods of the $1^{st}$ to $15^{th}$ unit periods, switching on the light modulator during the $16^{th}$ and $19^{th}$ unit periods, and switching off the light modulator during the remaining unit periods. Therefore, 8 gray levels "16", a gray level "8", and a gray level "1" are output and added up to a total gray level "137".

The number of times that the light modulator is switched in this embodiment is 19, which is a minor increase in comparison to 8 times shown in FIG. 2, but it's is a huge decrease in comparison to 255 times shown in FIG. 1. In addition, the light source outputs the maximum brightness during the $1^{st}$ to $15^{th}$ unit periods and lowers its output brightness gradually during only the last 4 unit periods. Thus, the overall brightness of the maximum gray level is merely reduced to about 84% (=(16*15+8+4+2+1)/16*19) of the maximum of the overall brightness the light source can output. In comparison with the gray level forming method shown in FIG. 2, the brightness of a gray level is substantially increased. Moreover, if the light source is a PWM light source, it has to be switched on or off at least 16 times during a unit period to generate light of which the ratio of the maximum brightness and the minimum brightness is 16:1. Namely, the switching frequency of the light source must be at least 16 times the switching frequency of the light modulator. In comparison with the gray level forming method shown in FIG. 2, the switching frequency of the light source is also decreased substantially, which makes the implementation easier.

However, the combination of the aforementioned number of times that the light modulator is switched and the corresponding light source brightness is merely an example. There are more possible combinations in practical terms. The concept of the invention is increasing the number of the unit periods where the light source outputs the maximum brightness. For example, it is preferred that the number of the unit periods where the light source outputs the maximum brightness is at least 60% of the total number of the unit periods. In this way, a balance between lowering the data bandwidth of the light modulator and raising the overall brightness is achieved.

Another possible gray level forming method in accordance with Embodiment 2 of the invention is described below. As the response time of modulating brightness of a light source depends on the characteristics of the light source itself and the light source driver, the switching speed of the light source may not be faster than the switching speed of the light modulator. If the response time of the light source driven by a switching (a pulse) of the light source driver is longer than a unit period of the light modulator, there is not enough time for the light source to generate a desired brightness during each unit period. Therefore, the gray level forming method in accordance with Embodiment 1 is unable to be utilized.

Figure 4:
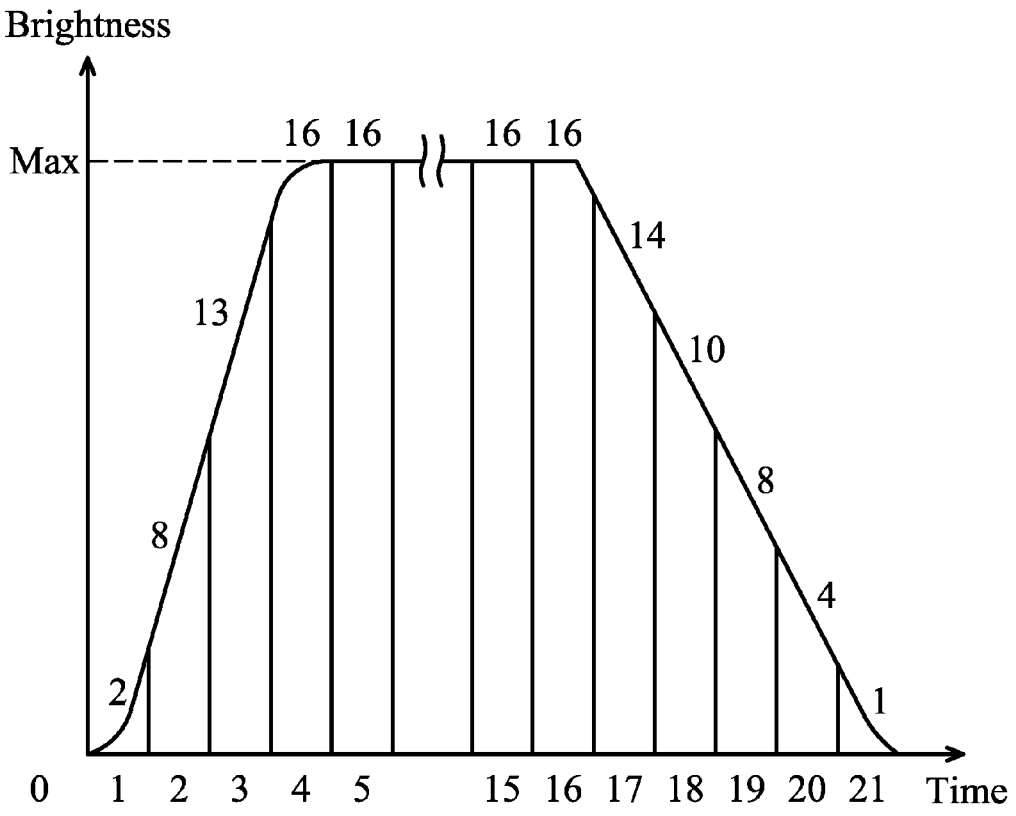
FIG. 4 is a diagram showing a gray level is formed by modulating a light modulator corresponding to a waveform of a light source in accordance with Embodiment 2 of the present invention.

FIG. 4 is a diagram showing a gray level is formed by modulating a light modulator corresponding to a waveform of a light source in accordance with Embodiment 2 of the present invention. In FIG. 4 the curve similar to a trapezoid represents a brightness waveform generated from a light source driven by a switching of the light source driver. In the period of the brightness waveform, the brightness is increased gradually from 0 to a maximum value and then is maintained at the maximum value for a while, and after that the brightness is decreased gradually to 0. In this embodiment, this period of brightness waveform of the light source is used as a total period for integrating gray levels. Here, the total period is divided into a plurality of the aforementioned unit periods, and gray levels are distributed to each unit period according to the waveform of the brightness. As an example shown in FIG. 4, a period of brightness waveform of the light source has 21 unit periods. A gray level value except for the gray level "0" to be output during a unit period corresponds to integration of the brightness during that unit period. Therefore, gray levels "2", "8", "13", "16", "16", "16", . . . , "16", "16", "14", "10", "8", "4", "1" are output sequentially. In the other words, during the $4^{th}$ to $16^{th}$ unit periods, the light source outputs the maximum brightness, and during the $1^{st}$ to $3^{rd}$ and $17^{th}$ to $21^{st}$ unit periods, the light source outputs a lower brightness.

In this gray level forming method of the embodiment, by no matter a PWM light source or a PAM light source, the switching frequency that the light source requires is decreased to 1/21 of the switching frequency of the light modulator. It is more applicable than requesting for a rapid switching frequency of a light source. Certainly, the brightness waveform of the light source and the total number of unit periods for the light modulator to modulate a total gray level are an example. There are countless practical combinations.

Note that the shape of the brightness waveform of the light source is not invariable, the brightness waveform may change because of factors such as manufacturing, and environment. Therefore, a concept of the invention is the length of the total period for the light modulator to modulate a total gray level and the distribution of the gray level output during each unit period can be adjusted according to the new brightness waveform. On the contrary, the invention also can set the length of the total period for integrating a gray level and the distribution of the gray level output during each unit period, and then adjust the brightness waveform of the light source by PWM or PAM to fit the setting.

Figure 5:
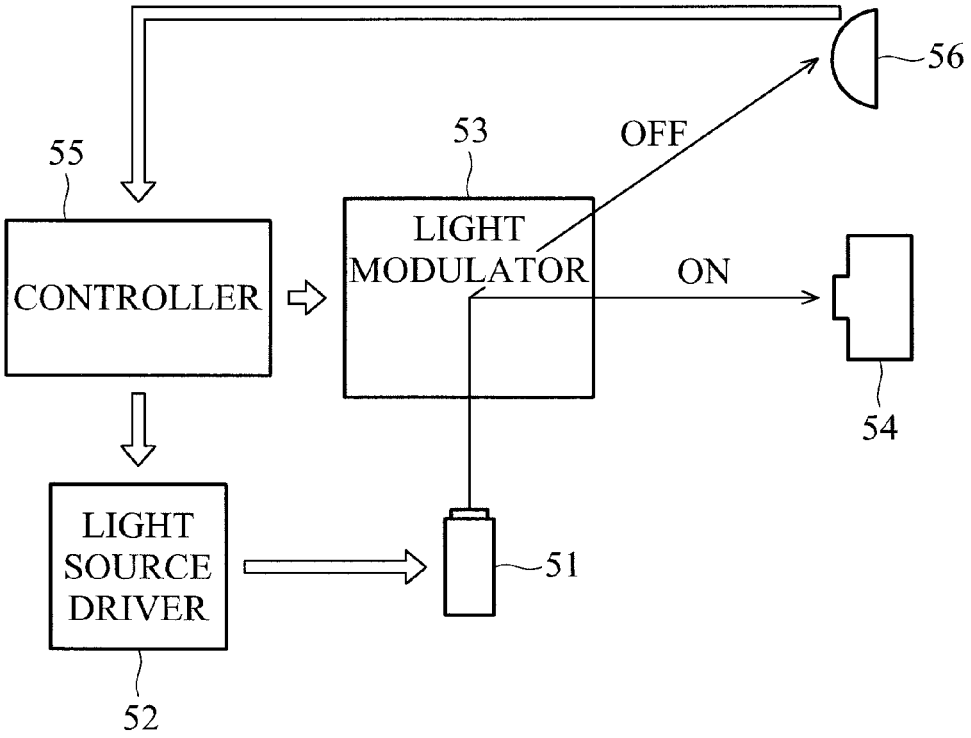
FIG. 5 is a structure diagram showing an optical projection system in accordance with Embodiment 3 of the present invention.

Following, a system for implementing the gray level control method in accordance with Embodiments 1 and 2 is described. FIG. 5 is a structure diagram showing an optical projection system in accordance with Embodiment 3 of the present invention. As shown in FIG. 5, the basic elements of an optical projection system include: a light source 51, a light source driver 52, a light modulator 53, a lens group 54, a controller 55, and a sensor 56.

The light source 51 is PWM light source or a PAM light source, which is driven by the light source driver 52 and changes its output brightness. The light modulator 53 selectively switches whether to output the light from the light source 51. When the light modulator 53 is switched on, the light from the light source 51 can pass the light modulator 53 and be incident to the lens group 54 for imaging. When the light modulator 53 is switched off, the light came from the light source 51 is incident to the sensor 56. The controller 55 is used to control the light modulator 53 and the light source driver 52 to make each unit period of the light modulator 53 synchronize with the period of a brightness variation of the light source 51.

If the optical projection system implements the gray level control method in accordance with Embodiment 1, the sensor 56 can be omitted. If the optical projection system implements the gray level control method in accordance with Embodiment 2, the sensor 56 is indispensable in consideration that the brightness waveform of the light source 51 may change. That is to say, the sensor 56 is used to sense the brightness waveform of the light source 51 and transmit the waveform information back to the controller 55. Then, as described above, the controller 55 controls the length of the total period for integrating a gray level and the distribution of the gray level output during each unit period according to the brightness waveform of the light source 51. Otherwise, the controller 55 presets the length of the total period for integrating a gray level and the distribution of the gray level output during each unit period and adjusts the pulse output from the light source driver 52 to adjust the brightness waveform of the light source 51.

According to the gray level control methods or the optical projection system described in the above embodiments, the invention can utilize the bandwidth of the light modulator effectively so as to be applicable in naked-eye 3D projectors that require more multi-view images, raise the brightness corresponding to a gray level, and reduce the switching frequency of the light source.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A gray level control method for outputting a total gray level during a total period consisting of M unit periods, comprising:

controlling a light source to continuously emitting light at variable brightness levels during the total period;

controlling a light modulator to be switched on to pass the light of the light source or be switched off to block the light source for each of the M unit periods;

selectively outputting one of a gray level "0" by switching on the light modulator and a specified gray level by switching off the light modulator during each unit period; and integrating the gray levels output during the M unit periods to obtain the total gray level, wherein during each of N successive unit periods of the M unit periods the specified gray level is a first gray level, and during each of the remaining (M−N) unit periods the specified gray level is lower than the first gray level, wherein M is a constant value, and the specified gray level for each unit period cannot be changed, and wherein the first gray level corresponds to the maximum brightness level that can be emitted by the light source.

2. The gray level control method as claimed in claim 1, wherein the gray levels output during the remaining (M−N) unit periods can be integrated to be any gray level lower than the first gray level.

3. The gray level control method as claimed in claim 1, wherein the ratio of N to M is at least 60%.

4. The gray level control method as claimed in claim 1, wherein M is 19, N is 15, the first gray level is a gray level "16", and the specified gray levels lower than the first gray level comprises: a gray level "8", a gray level "4", a gray level "2", and a gray level "1".

5. The gray level control method as claimed in claim 1, wherein the light source is a pulse width modulation light source, and the gray level output during a unit period corresponds to a number of times that the pulse width modulation light source is switched on during that unit period.

6. The gray level control method as claimed in claim 1, wherein the light source is a pulse width modulation light source or a pulse amplitude modulation light source, and the total period is in synchronization with the period of a brightness waveform generated from the light source driven by a pulse.

7. The gray level control method as claimed in claim 6, wherein the N successive unit periods are equal to a period in which the brightness is maintained at the maximum brightness in the brightness waveform, and the remaining (M−N) unit periods are distributed into a period in which the brightness increases gradually in the brightness waveform and a period in which the brightness decreases gradually in the brightness waveform.

8. The gray level control method as claimed in claim 6, further comprising:

adjusting the length of the total period or the arrangement of the M unit periods according to the brightness waveform.

9. The gray level control method as claimed in claim 6, further comprising:

adjusting the brightness waveform according to the arrangement of the M unit periods.

10. An optical projection system, comprising:

a light source;

a light source driver driving the light source to change the brightness of the light source;

a light modulator selectively switching whether or not to output the light from the light source; and a controller controlling the light modulator and the light source driver, wherein the controller controls the light modulator to be switched on or off for each one of M unit periods, and controls the light source driver to drive the light source to continuously output light at variable brightness levels during the M unit periods, wherein during each of N successive unit periods of the M unit periods the brightness level of the light source is equal to a first brightness, and during each of the remaining (M−N) unit periods the brightness level of the light source is lower than the first brightness, and wherein the overall brightness output from the light modulator during the M unit periods corresponds to a total gray level, wherein M is a constant value, and the brightness level for each unit period cannot be changed, and wherein the first brightness corresponds to the maximum brightness level that can be emitted by the light source.

11. The optical projection system as claimed in claim 10, wherein the overall brightness output from the light modulator during the remaining (M–N) unit periods can correspond to any gray level which is lower than the gray level represented by the first brightness.

12. The optical projection system as claimed in claim 11, wherein M is 19, N is 15, the first brightness corresponds to a gray level "16", and any gray level which is lower than the gray level of the first brightness comprises: a gray level "8", a gray level "4", a gray level "2", and a gray level "1".

13. The optical projection system as claimed in claim 10, wherein the ratio of N to M is at least 60%.

14. The optical projection system as claimed in claim 10, wherein the first brightness is the maximum brightness of the light source.

15. The optical projection system as claimed in claim 14, wherein the light source is a pulse width modulation light source, and the brightness output from the light source during a unit period corresponds to the number of times that the pulse width modulation light source is switched on during that unit period.

16. The optical projection system as claimed in claim 10, wherein the light source is a pulse width modulation light source or a pulse amplitude modulation light source, and the controller controls the light modulator and the light source driver to make the a total period consisting of the M unit periods be in synchronization with the period of a brightness waveform generated from the light source driven by a pulse.

17. The optical projection system as claimed in claim 16, wherein the N successive unit periods are equal to a period in which the brightness is maintained at the maximum brightness in the brightness waveform, and the remaining (M–N) unit periods are distributed into a period in which the brightness increases gradually in the brightness waveform and a period in which the brightness decreases gradually in the brightness waveform.

18. The optical projection system as claimed in claim 16, further comprising:

a sensor sensing the brightness waveform of light came from the light source through the light modulator, wherein the controller controls the light modulator to adjust the length of the total period or the arrangement of the M unit periods according to the brightness waveform sensed by the sensor.

19. The optical projection system as claimed in claim 16, further comprising:

a sensor sensing the brightness waveform of light came from the light source through the light modulator, wherein the controller controls the light source driver to adjust the brightness waveform of the light source according to the arrangement of the M unit periods.

* * * * *